United States Patent [19]

Scott

[11] Patent Number: 5,036,741

[45] Date of Patent: Aug. 6, 1991

[54] SAW APPARATUS WITH SAW COLLAR POSITIONING MEANS

[75] Inventor: Mark A. Scott, Bend, Oreg.

[73] Assignee: PIW Industries, Inc., Portland, Oreg.

[21] Appl. No.: 590,776

[22] Filed: Oct. 1, 1990

[51] Int. Cl.[5] ..... B26D 1/24

[52] U.S. Cl. ..... 83/508.2; 83/504; 83/698

[58] Field of Search ..... 83/498, 499, 500, 501, 83/502, 504, 507, 508.2, 508.3, 698, 425.3, 425.4

[56] References Cited

U.S. PATENT DOCUMENTS 3,202,189 8/1965 Pearson ..... 83/508.3
3,865,000 2/1975 Stafford ..... 83/504
4,414,875 11/1983 Pearson ..... 83/508.3
4,592,259 6/1986 Görner et al. ..... 83/508.3
4,781,668 11/1988 Mowry ..... 83/508.3

*Primary Examiner*—Frank T. Yost
*Assistant Examiner*—Scott A. Smith
*Attorney, Agent, or Firm*—Kolisch, Hartwell, Dickinson, McCormack & Heuser

[57] ABSTRACT

Saw mechanism including a power-rotated saw arbor. A shifter is mounted on the arbor at one location, and a saw collar is mounted on the arbor at another, spaced location. A shifter bar extends between the shifter and collar. A tapered element extending from the shifter seats within a corresponding tapered seat on one end of the shifter bar, and another tapered element extended from the collar seats within a correspondingly tapered seat on the opposite end of the shifter bar.

8 Claims, 2 Drawing Sheets

SAW APPARATUS WITH SAW COLLAR POSITIONING MEANS

This invention relates to saw apparatus, and more to apparatus of this description which includes one or more saws suitably mounted on a power-driven saw arbor with the saws being adjustable in a direction extending axially of the arbor. Saw apparatus of this description is exemplified by a socalled gang ripsaw, which includes multiple circular saws adjustable along an arbor and laterally of each other to change the width of the boards cut by the machine.

In U.S. Pat. No. 4,414,875, gang saw apparatus is disclosed wherein a shifter mechanism or shifter is connected by a shifter strap with a saw collar mounting a saw. In this way, when the shifter is displaced in a direction extending axially along the saw arbor, the shifter strap causes a similar displacement of the saw collar along the arbor. A connection is established between the shifter and one end of the shifter strap by a pin which has an end received within a bore provided in the end of the shifter strap.

This invention concerns an improvement in apparatus of the type disclosed in the aforementioned patent, which is effective to produce more precise positioning of a saw in response to displacement of a shifter which is connected to the collar mounting the saw. In this connection, it should be remembered that a machine that affords accurate dimensional cutting of wood results in a more efficient utilization of material than a machine wherein saw position is subject to variation after adjustment, even though such variation is within a few thousandths of an inch.

An object of this invention, therefore, is to provide saw apparatus with improved means for adjustably positioning a saw along the length of an arbor whereby more precise dimensional cutting is possible.

More particularly, an object is to provide such apparatus wherein a connection between a shifter and a saw collar positioned along the arbor from the shifter is established through a tapered element which seats within a correspondingly tapered seat. With an arbor rotated, centrifugal force results, which causes the tapered element to seat snugly within the seat described with the elimination of any relative play. As a consequence, any displacement of the part having the tapered element is exactly followed by a corresponding displacement in the part having the tapered seat.

In a preferred embodiment of the invention, a shifter bar or strap extends from one end which is adjacent a shifter and an opposite end which is adjacent a saw collar. So-called shifter bar inserts are screwed into each of the opposite ends of the shifter strap. These have conical outwardly facing recesses therein which snugly seat the tapered ends of elements projecting from the shifter (which is at one end of the strap) and from the saw collar (which is adjacent the opposite end of the strap).

These and other object and advantages are attained by the invention, which is described hereinbelow in conjunction with the accompanying drawings, wherein.

Figure 1:
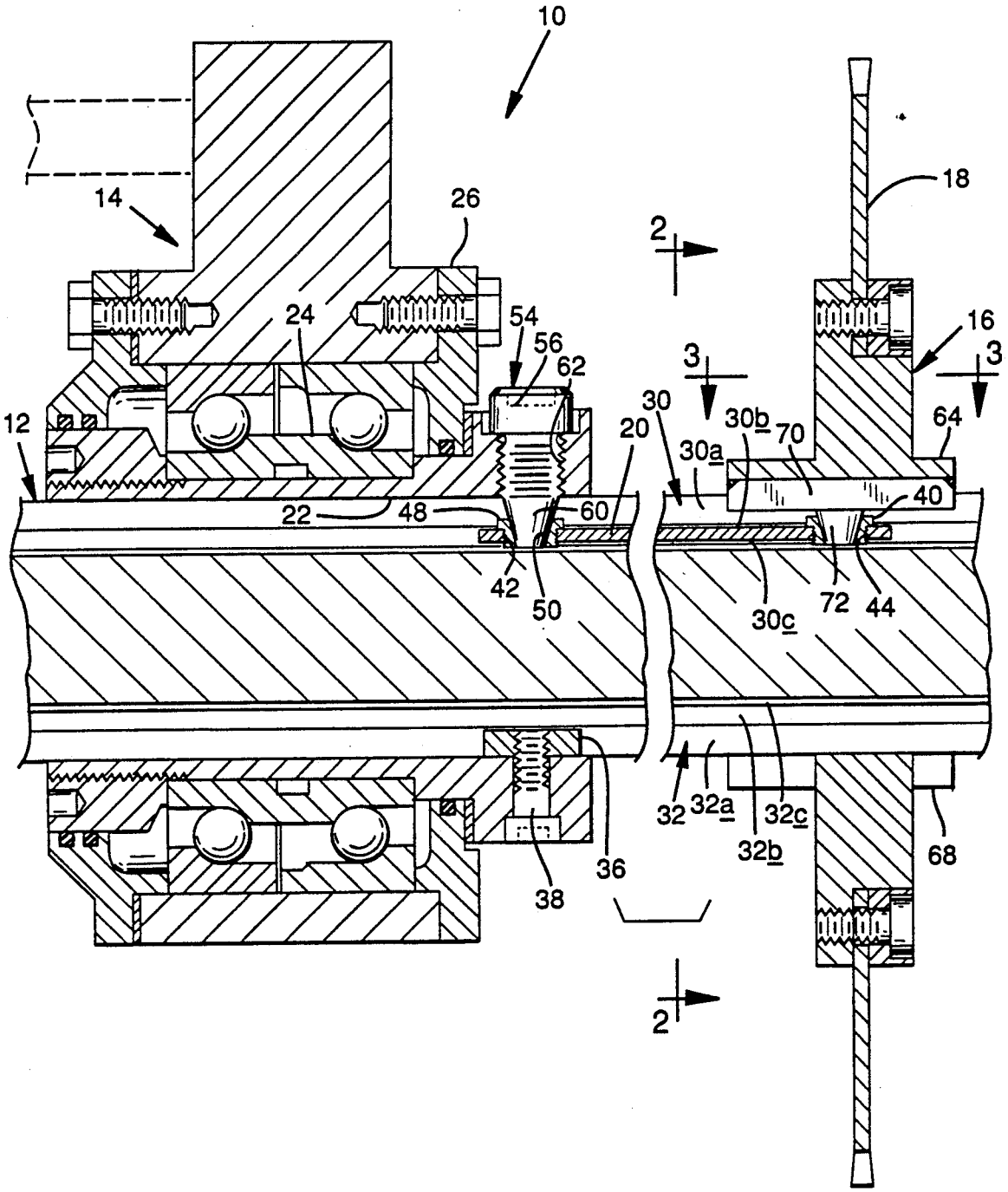
FIG. 1 is a view illustrating portions of a power-driven saw arbor and showing a shifter and saw collar supported on the arbor at positions spaced axially along the arbor.

Referring to FIG. 1, a saw apparatus 10 is illustrated which includes a power-driven rotatable saw arbor, portions of which are shown at 12. Mounted on the saw arbor and indicated generally at 14 is what is referred to herein as a shifter mechanism or shifter. Also mounted on the arbor and spaced axially on the arbor from the shifter is a saw collar designated 16.

Suitably mounted on the saw collar is a saw blade 18. The shifter and saw collar are interconnected by means which will be more fully described and which includes a shifter strap or bar 20. As the result of the interconnection, when the shifter is displaced axially along the saw arbor, a similar axial displacement occurs in the saw collar and the saw blade that it mounts.

Shown and described herein are only one shifter and an interconnected saw collar. It should be understood, however, that the invention, as in the gang saw apparatus of the aforementioned U.S. Pat. No. 4,414,875, may be employed in an organization where there are plural saw collars provided, each saw collar being relatively displaceable along the saw arbor to change the lateral spacing between the saws which are supported on the collars, and each saw collar being interconnected with a shifter, which is mounted on the arbor in a position spaced from the saw collar along the length of the arbor.

Describing in more detail the shifter, it includes an inner part of sleeve 22 which directly encircles the arbor. Supported on this sleeve or inner part is the inner race of a bearing assembly 24. The outer race of this bearing assembly is mounted on what is referred to as an outer part of the shifter indicated generally at 26.

With the saw apparatus operating, the saw arbor rotates under power and, as will be described, the inner part of the shifter is keyed to the arbor to rotate with the arbor. The outer part of the shifter, however, while being displaceable along the length of the arbor, does not rotate with the arbor. A conventional set works (not shown) is connected through a shifter rod with this outer part of the shifter and with actuation of the set works, the shifter rod is extended or retracted to produce the desired positioning of the shifter. Reference is again made to U.S. Pat. No. 4,414,875 for a disclosure of such a set works and a shifter rod.

Figure 2:
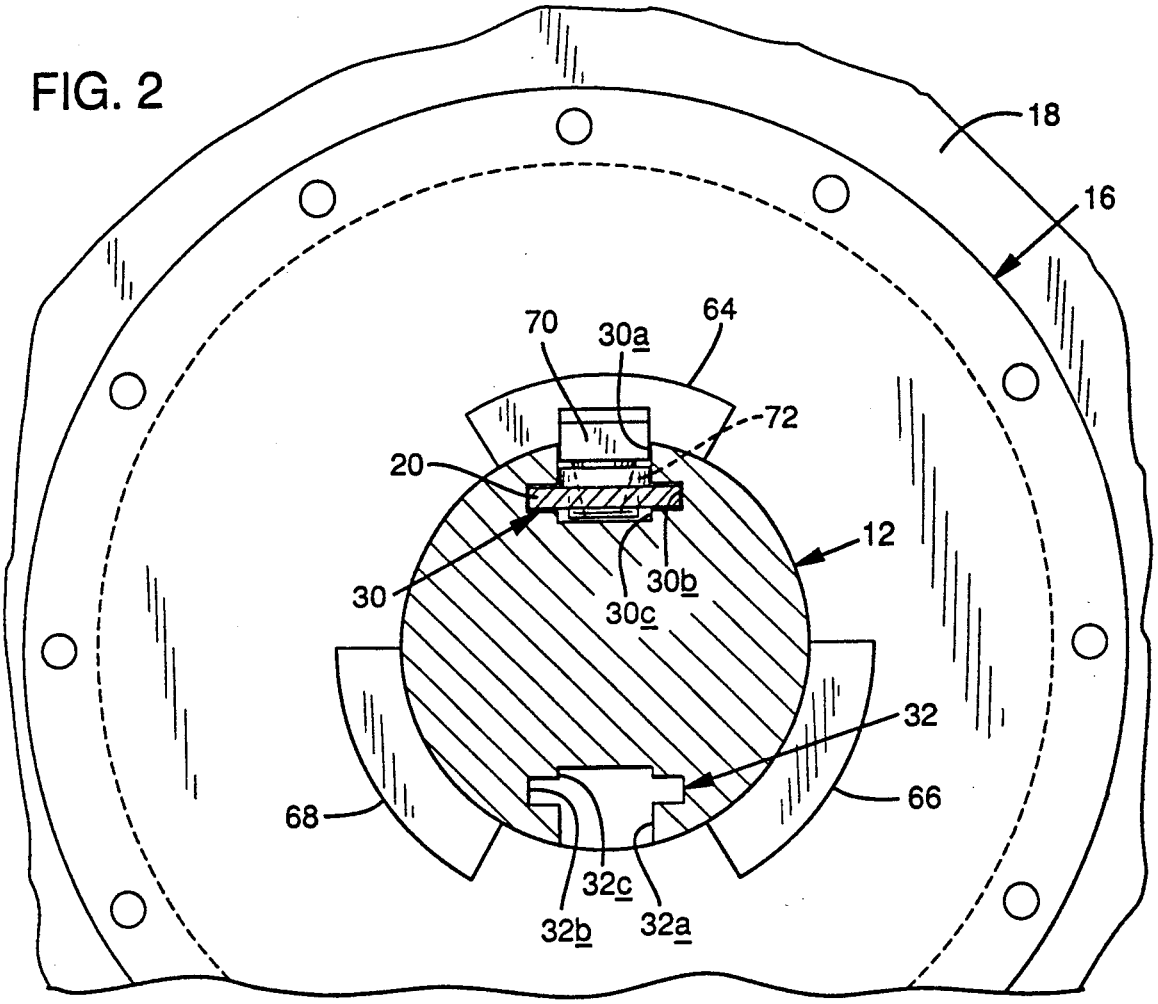
FIG. 2 is a cross-sectional view, taken generally along the line 2—2 in FIG. 1.
Figure 3:
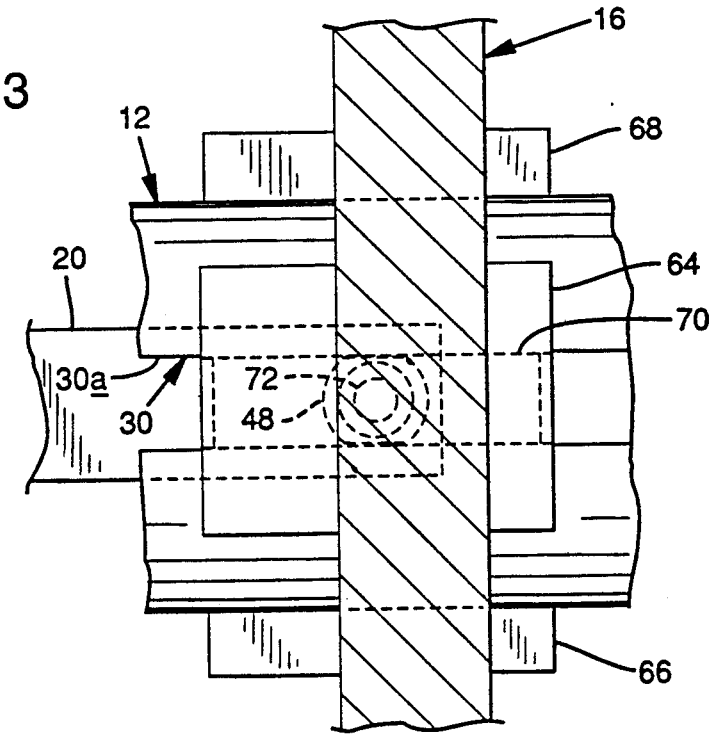
FIG. 3 is a cross-sectional view taken generally along the line 3—3 in FIG. 1.

Arbor 12 is formed with a pair of elongate keyways or channels extending along its length and indented inwardly from diametrically opposite sides of its periphery. The channels as illustrated have been given the reference numerals 30 and 32. Referring to FIG. 2, each keyway has an outer portion, shown for the channels 30*a* and 32*a*, and these open to the periphery of the saw arbor. The outer portions join with inner portions 30*b*, 32*b*, and these inner portions have a greater width than the outer portions. Joining with the inner portions are relatively shallow base portions, as demonstrated by base portion 32*c*, these having approximately the width of the outer portions.

Inner part 22 of the shifter was earlier described as keyed to the arbor to rotate with the arbor. This is accomplished by providing a key, such as key 36 which rides within the outer portion of a keyway, for example, portion 32*a* as shown in FIG. 1. The key has a width substantially equalling the width of the outer portion. The key is secured to the inner part in a suitable manner, as with fastener 38.

Shifter bar or strap 20 lodges within the inner portion of a keyway, as exemplified by inner portion 30*b*. The strip ordinarily has a width which is only slightly less than the width of the inner portion of a keyway, and is disposed with the width of the strip spanning the width of the inner portion of the keyway.

As best shown in FIG. 1, strip 20 is provided adjacent each of its opposite ends with an internally threaded bore, these being shown at 42 and 44, respectively. Screwed into each of these bores is what is referred to as a shifter bar insert 48. The shifter bar insert has external threads thereon to accommodate such being turned into one of the bores 42, 44. It also has a tapered channel extending therethrough, shown at 50. With the shifter bar within the keyway each shifter bar insert becomes positioned with its tapered channel 50 enlarging in size progressing in a direction extending radially outwardly on the arbor.

Interconnecting sleeve or inner part 22 with an end of the shifter bar is a shifter cap screw 54. A hex broach 56 provides for a fitting of a screw driver tool to turn the cap screw. Intermediate the ends of the cap screw is a threaded portion, and the end of the cap screw is provided with a tapered I0 terminus 60.

The cap screw is mounted on sleeve 22 with such screwed into an internally threaded bore 62. The tapered terminus of the cap screw extends downwardly into a keyway to be snugly received within the tapered channel of a shifter bar insert, the taper of the channel complementing the taper of the terminus in the cap screw.

The saw collar is slidably supported on the periphery of the arbor by way of three pads equally circumferentially spaced about the arbor and these having inner circumferential surfaces convexly curved to match the curvature of the periphery of the arbor. In this connection, the mounting of the collar is similar to that described for the collars in U.S. Pat. No. 4,414,875. In FIG. 2, the pads are shown at 64, 66, and 68.

Suitably mounted on the inner side of one of the pads is a saw collar key shown at 70. This saw collar key has a width only slightly less than the width of the outer portion of a keyway and rides within this outer portion. In this way, rotation of the arbor is transmitted to the collar.

Projecting from the base of the key and joined to the key is a tapered element or pin 72. This element is tapered correspondingly to the taper appearing on the inside of a shifter bar insert. With the parts assembled, element 72 is snugly received within the tapered channel of an insert at the opposite end of the shifter bar or strap.

Keyway 30 has been described in the mounting of the bar or strap 20 interconnecting the shifter and saw collar 16. The other keyway may be used similarly to house within its inner portion 30i b the shifter bar or strap interconnecting another shifter and another saw collar.

With the construction described, it should be obvious that extremely precise positioning of the saw arbor may be produced through adjustments in the shifter. This is because any clearance or play, which exists between a tapered element and the shifter bar insert that receives it, is substantially eliminated with rotation of the arbor under the action of centrifugal force which throws the shifter bar outwardly to produce an evermore snug fitting between the tapered elements and the shifter bar inserts. The apparatus contemplated is dependable, and relatively easily maintained.

While a specific embodiment of the invention has been described, variations and modifications are possible without departing from the invention.

It is claimed and desired to secure by letters patent:

1. In saw apparatus which includes a power-rotated saw arbor, a saw shifter mounted on said arbor, and a saw collar mounted on said arbor spaced axially on the arbor from the shifter, a shifter bar parallelling the axis of the arbor, and connecting means connecting opposite ends of the shifter bar to the shifter and collar, respectively, said connecting means including, for at least one end of the shifter bar, a tapered element projecting from the bar and extending radially toward the center of the arbor and a correspondingly tapered seat receiving the tapered element carried by the end of the bar, whereby centrigual forces during operation effect a snug fit between said tapered element and said tapered seat.

2. The apparatus of claim 1, wherein the arbor has an elongate keyway extending axially on the arbor indented inwardly on the periphery of the arbor, and said shifter bar is disposed within the keyway and said tapered seat lies within said keyway.

3. The apparatus of claim 2, wherein the keyway has a radially outer portion opening to the periphery of the arbor and a radially inner portion opening inwardly of the outer portion, the width of the inner portion exceeding the width of said outer portion, the shifter bar having a width which exceeds the width of said outer portion and lying within said inner portion with the width of the bar spanning the width of the inner portion.

4. The apparatus of claim 1, wherein said one end of the shifter bar has an internally threaded bore extending therethrough, and an externally threaded shifter bar insert is screwed into said bore, and said shifter bar insert has said tapered seat forme therein.

5. In saw apparatus which includes a power-rotated saw arbor, a saw shifter mounted on said arbor, and a saw collar mounted on said spaced axially on the arbor from the shifter, a shifter bar parallelling the axis of the arbor extending between the shifter and the collar, means connecting the shifter and one end of the shifter bar including a tapered element projecting from the bar and extending radially toward the center of the arbor and a correspondingly tapered seat receiving the element carried by said one end of the bar, and another means connecting the collar and the opposite end of the shifter including another tapered element projecting from the bar and extending radially toward the center of the arbor and another correspondingly tapered seat receiving said other element carried by said opposite end of the bar whereby centrigual forces during operation effect a snug fit between said tapered elements and said tapered seats.

6. The apparatus of claim 5, wherein the arbor has an elongate keyway extending axially on the arbor indented inwardly from the periphery of the arbor, and said shifter bar is lodged within said keyway, and said tapered seat of said first connecting means lies within the keyway and said tapered seat of said other connecting means lies within the keyway.

7. The apparatus of claim 5, wherein said one and said opposite ends of the shifter bar each have an internally threaded bore extending therethrough, an externally threaded shifter bar insert is screwed into each of said bores, and each insert has a tapered seat formed therein.

8. The apparatus of claim 7, wherein said tapered element of said first connecting means comprises the tapered end of a cap screw, and wherein said shifter includes a portion encircling said arbor and rotatable with said arbor, said cap screw being adjustably mounted on said portion of said shifter.

* * * * *